US011553798B2

(12) United States Patent
Melnik

(10) Patent No.: US 11,553,798 B2
(45) Date of Patent: Jan. 17, 2023

(54) ACTIVE FITNESS CHAIR WITH AN EXERCISE ARMREST

(71) Applicant: Irina L. Melnik, San Francisco, CA (US)

(72) Inventor: Irina L. Melnik, San Francisco, CA (US)

( * ) Notice: Subject to any disclaimer, the term of this patent is extended or adjusted under 35 U.S.C. 154(b) by 0 days.

(21) Appl. No.: 16/988,672

(22) Filed: Aug. 9, 2020

(65) Prior Publication Data

US 2022/0054881 A1 Feb. 24, 2022

Related U.S. Application Data

(63) Continuation-in-part of application No. 15/961,872, filed on Apr. 25, 2018, now Pat. No. 10,813,464, (Continued)

(51) Int. Cl.
*A47C 9/00* (2006.01)
*A47C 1/024* (2006.01)
(Continued)

(52) U.S. Cl.
CPC ..... *A47C 9/002* (2013.01); *A47C 1/0242* (2013.01); *A63B 21/045* (2013.01); *A63B 21/05* (2013.01);
(Continued)

(58) Field of Classification Search
CPC . A47C 1/0242; A47C 9/002; A63B 21/00058; A63B 21/00069; A63B 21/00072; A63B 21/00076; A63B 21/00178; A63B 21/00181; A63B 21/00185; A63B 21/00192; A63B 21/002; A63B 21/0023; A63B 21/005; A63B 21/0051; A63B 21/0052; A63B 21/0058; A63B 21/0059; A63B 21/008; A63B 21/0083; A63B 21/0084; A63B 21/00845; A63B 21/0085; A63B 21/0087;
(Continued)

(56) References Cited

U.S. PATENT DOCUMENTS 4,411,469 A * 10/1983 Drabert ..... A47C 31/126 297/321
5,348,372 A * 9/1994 Takamatsu ..... A47C 1/03274 297/301.1
(Continued)

FOREIGN PATENT DOCUMENTS

JP 2004181179 A * 7/2004
JP 4185623 B2 * 11/2008 ..... A47C 1/03
KR 102118553 B1 * 6/2020 ..... A47C 7/541

*Primary Examiner* — Gary D Urbiel Goldner

(57) ABSTRACT

In one aspect, an active exercise chair comprises: a seat support, wherein the seat support is rigidly affixed to a top section of a shaft of a gas spring; a seat, wherein the seat is connected to the seat support; a seatback support, wherein the seatback support is pivotably connected to the seat support about a discrete pivot point; a seatback carriage, wherein the seatback carriage is slidably connected to the seatback support, wherein the seatback carriage is connected to a seatback, and wherein the seatback traverses a translational path defined by a geometry of the seatback carriage and the seatback support.

17 Claims, 18 Drawing Sheets

Related U.S. Application Data which is a continuation-in-part of application No. 15/155,058, filed on May 15, 2016, now Pat. No. 9,981,158.

(60) Provisional application No. 62/162,317, filed on May 15, 2015.

(51) Int. Cl.
*A63B 21/00* (2006.01)
*A63B 21/045* (2006.01)
*A63B 21/05* (2006.01)

(52) U.S. Cl.
CPC ..... *A63B 21/4031* (2015.10); *A63B 21/4047* (2015.10)

(58) Field of Classification Search
CPC ... A63B 21/0088; A63B 21/02; A63B 21/023; A63B 21/025; A63B 21/026; A63B 21/04; A63B 21/0407; A63B 21/0414; A63B 21/0421; A63B 21/0428; A63B 21/0435; A63B 21/0442; A63B 21/045; A63B 21/0455; A63B 21/05; A63B 21/055; A63B 21/0552; A63B 21/0555; A63B 21/0557; A63B 21/068; A63B 21/15; A63B 21/151; A63B 21/152; A63B 21/153; A63B 21/154; A63B 21/158; A63B 21/159; A63B 21/16; A63B 21/1609; A63B 21/4027; A63B 21/4039; A63B 21/4031; A63B 21/4033; A63B 21/4034; A63B 21/4035; A63B 21/4041; A63B 21/4045; A63B 21/4047; A63B 21/4049; A63B 2023/006; A63B 23/02; A63B 23/0205; A63B 23/0211; A63B 23/0222; A63B 23/0233; A63B 23/0238; A63B 23/12; A63B 23/1209; A63B 24/0003; A63B 24/0006; A63B 24/021; A63B 24/0059; A63B 24/0062; A63B 24/0087; A63B 2024/0009; A63B 2024/0012; A63B 2024/0025; A63B 2024/0065; A63B 2024/0068; A63B 2024/0071; A63B 2024/009; A63B 2024/0093; A63B 2024/0096; A63B 69/0057; A63B 69/0059; A63B 71/0054; A63B 71/0619; A63B 71/0622; A63B 2071/0072; A63B 2071/0647; A63B 2071/065; A63B 2071/0652; A63B 2071/0655; A63B 2071/0694; A63B 2208/02; A63B 2208/0228; A63B 2208/0233; A63B 2213/004; A63B 2220/10; A63B 2220/13; A63B 2220/16; A63B 2220/17; A63B 2220/30; A63B 2220/34; A63B 2220/40; A63B 2220/44; A63B 2220/50; A63B 2220/51; A63B 2220/52; A63B 2220/54; A63B 2220/56; A63B 2220/62; A63B 2220/64; A63B 2220/80; A63B 2220/803; A63B 2220/805; A63B 2225/09; A63B 2225/093; A63B 2225/20; A63B 2225/50; A63B 2030/06; A63B 2030/08; A63B 2030/30; A63B 2030/40; A63B 2030/50; A63B 2030/60; A63B 2030/62; A63B 2030/65; A63B 2030/75
See application file for complete search history.

(56) References Cited

U.S. PATENT DOCUMENTS 5,556,163 A * 9/1996 Rogers, III ..... A47C 1/023 297/362.11
5,570,301 A * 10/1996 Barrus ..... G01G 19/44 702/41
5,776,084 A * 7/1998 Wolan ..... A61H 1/0292 482/111
7,163,263 B1 * 1/2007 Kurrasch ..... A47C 31/008 297/217.3
7,261,368 B1 * 8/2007 Clausnitzer ..... A47C 9/002 297/118
7,686,396 B2 * 3/2010 Schaaf ..... A47C 7/446 297/313
8,596,716 B1 * 12/2013 Caruso ..... B60N 2/0228 297/217.3
9,138,061 B1 * 9/2015 Eisenberg ..... A47C 1/03261
9,326,608 B1 * 5/2016 Hoy ..... A47C 1/0345
9,848,705 B2 * 12/2017 Probst ..... A47C 7/54
9,981,158 B2 * 5/2018 Melnik ..... A63B 21/4047
10,383,445 B2 * 8/2019 Serber ..... A47C 9/002
10,813,464 B2 * 10/2020 Melnik ..... A47C 9/002
2002/0167486 A1 * 11/2002 Tan ..... A61B 5/1116 345/156
2003/0055365 A1 * 3/2003 Hazard ..... A61H 9/0085 601/103
2003/0073552 A1 * 4/2003 Knight ..... A47C 9/002 482/148
2004/0195876 A1 * 10/2004 Huiban ..... A47C 9/002 297/217.3
2005/0091817 A1 * 5/2005 Eger ..... A47C 31/126 29/407.01
2005/0209049 A1 * 9/2005 Shields ..... G09B 23/28 482/8
2006/0226289 A1 * 10/2006 Robbins ..... B60N 2/501 244/122 R
2007/0210634 A1 * 9/2007 Krehm ..... A47C 31/126 297/303.1
2008/0100121 A1 * 5/2008 Serber ..... A47C 9/002 297/452.1
2008/0242521 A1 * 10/2008 Einav ..... G16H 20/30 482/110
2009/0058661 A1 * 3/2009 Gleckler ..... A47C 31/126 340/573.7
2009/0079238 A1 * 3/2009 Plikat ..... A47C 31/126 297/217.2
2009/0261637 A1 * 10/2009 Schmitz ..... A47C 3/026 297/217.2
2009/0273213 A1 * 11/2009 Mukherjee ..... B64D 11/06395 297/217.3
2009/0278391 A1 * 11/2009 Ulrich ..... A47C 7/443 297/283.1
2010/0181815 A1 * 7/2010 Highlander ..... A47C 7/4454 403/53
2011/0269601 A1 * 11/2011 Nelson ..... A63B 71/0622 482/8
2011/0275939 A1 * 11/2011 Walsh ..... G09B 19/003 434/257
2012/0184410 A1 * 7/2012 Foster ..... A63B 21/023 482/92
2013/0011819 A1 * 1/2013 Horseman ..... A61B 5/0537 434/257
2013/0012786 A1 * 1/2013 Horseman ..... A61B 5/002 600/301
2013/0113252 A1 * 5/2013 Kuenzler ..... A47C 7/14 297/284.3
2013/0313871 A1 * 11/2013 Shalaby ..... A47C 31/126 297/217.2
2014/0265460 A1 * 9/2014 Voigt ..... A47C 7/006 297/170
2015/0015399 A1 * 1/2015 Gleckler ..... A61B 5/6891 340/573.7
2015/0142381 A1 * 5/2015 Fitzsimmons ..... A47C 3/20 702/166

(56) References Cited

U.S. PATENT DOCUMENTS

| | | | | |
|---|---|---|---|---|
| 2015/0173515 | A1* | 6/2015 | Freedman | B62J 1/005 297/313 |
| 2015/0201758 | A1* | 7/2015 | Serber | A47C 1/023 297/300.2 |
| 2015/0273269 | A1* | 10/2015 | Chen | A63B 21/4047 482/142 |
| 2015/0351692 | A1* | 12/2015 | Pereny | A61B 5/1116 702/139 |
| 2015/0352990 | A1* | 12/2015 | Zouzal | B60N 2/002 297/284.3 |
| 2016/0184634 | A1* | 6/2016 | Yanev | A63B 21/4013 482/8 |
| 2016/0324713 | A1* | 11/2016 | Halperin | A61H 9/0078 |

* cited by examiner 402 408

408 410

ACTIVE FITNESS CHAIR WITH AN EXERCISE ARMREST

CLAIM OF PRIORITY AND INCORPORATION BY REFERENCE

This application claims priority to U.S. application Ser. No. 15/961,872 filed on May 15, Apr. 25, 2018 and titled ACTIVE FITNESS CHAIR APPLICATION. This application is hereby incorporated by reference in its entirety for all purposes.

U.S. application Ser. No. 15/961,872 claims priority to U.S. application Ser. No. 15/155,058 filed on May 15, 2016 and titled ACTIVE FITNESS CHAIR APPLICATION. This application is hereby incorporated by reference in its entirety for all purposes.

U.S. application Ser. No. 15/155,058 application claims priority from U.S. Provisional Application No. 62/162,317, title DYNAMIC WELLNESS CHAIR and filed 15 May 2015. U.S. application Ser. No. 15/155,058 application is hereby incorporated by reference in its entirety for all purposes. This application claims priority from U.S. Provisional Application No. 62/336,722, titled ACTIVE FITNESS CHAIR APPLICATION and filed 15 May 2016. This application is hereby incorporated by reference in its entirety for all purposes.

BACKGROUND

1. Field

This application relates generally to exercise devices, and more specifically to a system, article of manufacture and method for an active fitness chair application with an exercise armrest.

2. Related Art

Increasing, workers are employed in jobs that require a lot of sitting. Sitting can lead to various health issues such as muscle weakness, back pain, weight gain, and the like. Workers may not be motivated to exercise and/or perform other activities that counteract the negative effects of passive sitting. Accordingly, an active exercise chair can transform sitting into an active activity and improve the health of the worker.

BRIEF SUMMARY OF THE INVENTION

In one aspect, an active exercise chair comprising seat support, wherein the seat support is rigidly affixed to a top section of a shaft of the gas spring; a seat, wherein the seat is connected to the seat support; a seatback support, wherein the seatback support is pivotably connected to the seat support about a discrete pivot point; a seatback carriage, wherein the seatback carriage is slidably connected to the seatback support, wherein the seatback carriage is connected to a seatback, and wherein the seatback traverses a translational path defined by the geometry of the seatback carriage and the seatback support; an adjustment carriage that enables a user to modify a torque profile exerted by a force providing element to the seatback support about a pivot connecting the seat support to the seatback support, and wherein an end of the force providing element is pivotably connected to the adjustment carriage, and wherein the adjustment carriage is slidably connected to the lower portion of the seatback support; and an exercise armrest comprising a resistance element provides a resistance force from a user's arm motion while a forearm of the user rests upon the exercise armrest.

The Figures described above are a representative set and are not an exhaustive with respect to embodying the invention.

DESCRIPTION

Disclosed are a system, method, and article of manufacture of an active fitness chair with an exercise armrest. The following description is presented to enable a person of ordinary skill in the art to make and use the various embodiments. Descriptions of specific devices, techniques, and applications are provided only as examples. Various modifications to the examples described herein can be readily apparent to those of ordinary skill in the art, and the general principles defined herein may be applied to other examples and applications without departing from the spirit and scope of the various embodiments.

Reference throughout this specification to "one embodiment," "an embodiment," 'one example,' or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to provide a thorough understanding of embodiments of the invention. One skilled in the relevant art can recognize, however, that the invention may be practiced without one or more of the specific details, or with other methods, components, materials, and so forth. In other instances, well-known structures, materials, or operations are not shown or described in detail to avoid obscuring aspects of the invention.

Definitions

Actuator can be a type of motor that is responsible for moving or controlling a mechanism or system.

Isometric can be a form of resistance exercise in which one's muscles are used in opposition with other muscle groups.

Isometric contraction can occur when the muscle tenses while not changing length. Examples of isometric contraction can include poses in body building and/or pushing against an immoveable object.

Transducer can be a device that converts one form of energy to another form of energy.

Exemplary Architecture

Figure 1:
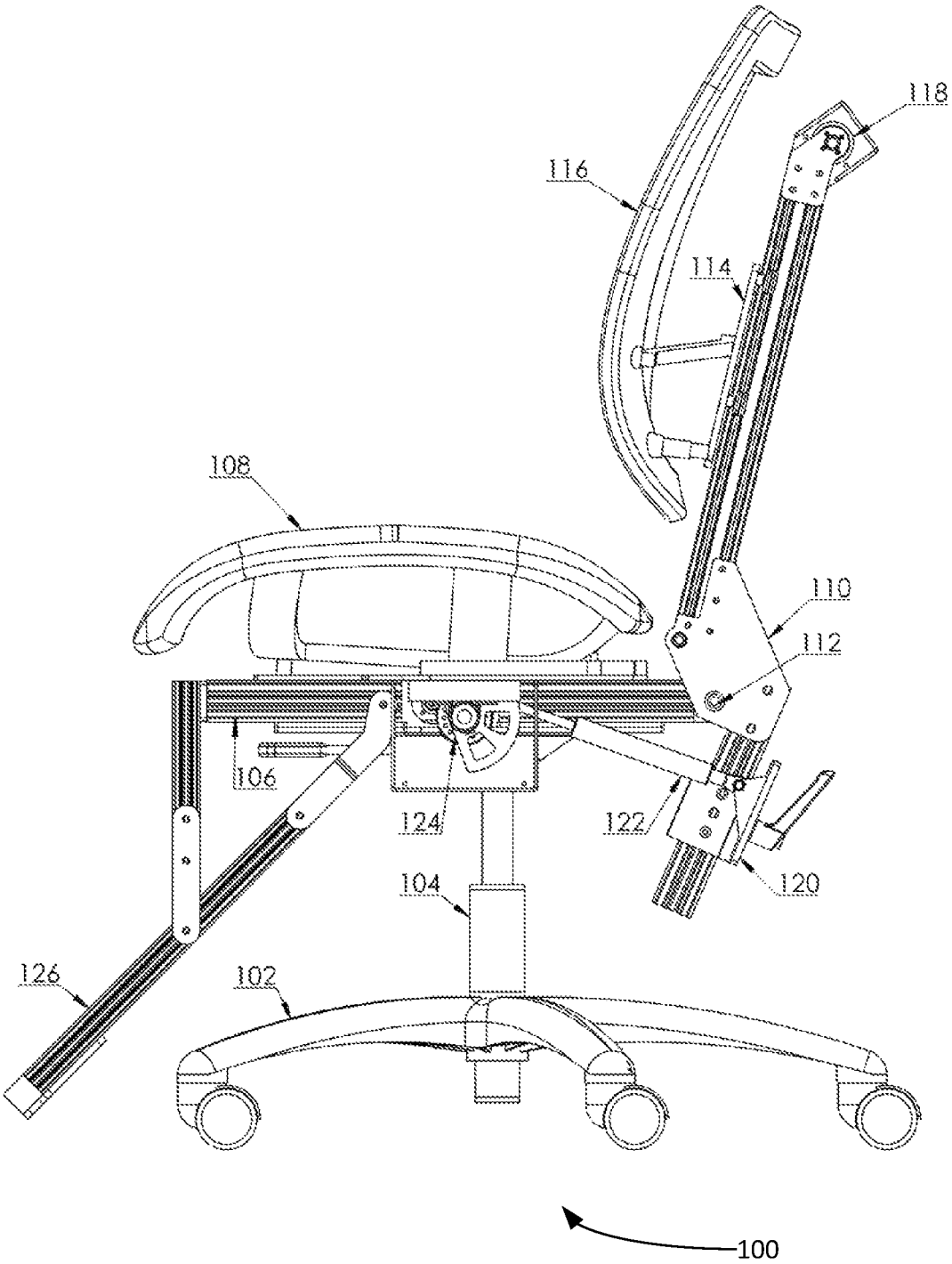
FIG. 1 illustrates a side view of an embodiment of an active exercise chair, according to some embodiments.

FIG. 1 illustrates a side view of an embodiment of an active exercise chair 100, according to some embodiments. Active exercise chair 100 is supported by a caster assembly 102 for mobility, and a locking gas spring assembly 104 for providing height adjustment. These features are typical of ordinary office chairs and will not be discussed further. The seat support 106 is rigidly affixed to the top section of the gas spring's shaft. The seat 108 is rigidly, pivotably, and/or slidably connected to the seat support (e.g. slidable connections have been discussed for balance purposes, etc.). A seatback support 110 is pivotably connected to the seat support about a discrete pivot point 112. A seatback carriage 114 is slidably connected to the seatback support. The seatback 116 is rigidly, pivotably about one or more axis, and/or slidably connected to the seatback carriage 114. The seatback may traverse a translational path defined by the geometry of the seatback carriage 114 and seatback support (e.g. the motion is not necessarily strictly linear, etc.). The impetus for the translational motion of the seatback carriage 114 may be provided by a contact force between the user's back and the seatback, or by an explicit mechanical coupling between the pivotably connected members of the seatback support 110 and the seat support 106, or by some combination thereof. The seatback carriage 114 is held in a position such that it may translate toward the pivot when the chair is being reclined by the user. To accomplish this in the current implementation a counterbalance assembly 118 consisting of a rotating drum and one or more constant-force springs to counteract the force of gravity acting on the seatback 116 and seatback carriage 114 when the seatback support 110 is in the upright position.

An adjustment carriage 120 allows the user to modify the torque profile exerted by the force providing element(s) 122 to the seatback support about the pivot connecting the seat support to the seatback support. In one embodiment, force providing element(s) 122 can be 2× gas springs. However, in other examples, force could be one or more compression springs, leaf springs, linear actuators, etc. Likewise, in yet another embodiment, force providing element(s) 122 could be replaced by a torsional spring assembly or rotary actuator.

One end of the force providing element(s) is/are pivotably connected to the adjustment carriage 120. The adjustment carriage is slidably connected to the lower portion of the seatback support 110. By moving the adjustment carriage further from the location of the pivot the magnitude of the torque produced at the pivot is increased. Likewise, by moving the adjustment carriage closer to the pivot the magnitude of the torque produced at the pivot is reduced.

Figure 3A:
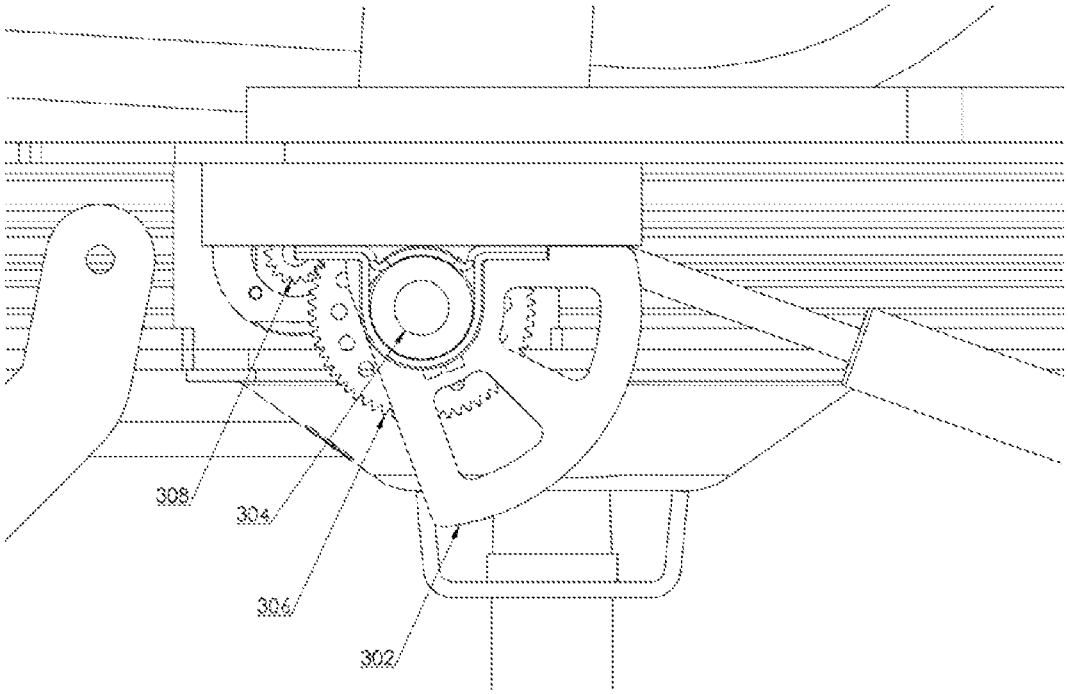
FIGS. 3 A-B illustrate an example embodiment with a pivot mounted to a selector plate, according to some embodiments.
Figure 3B:
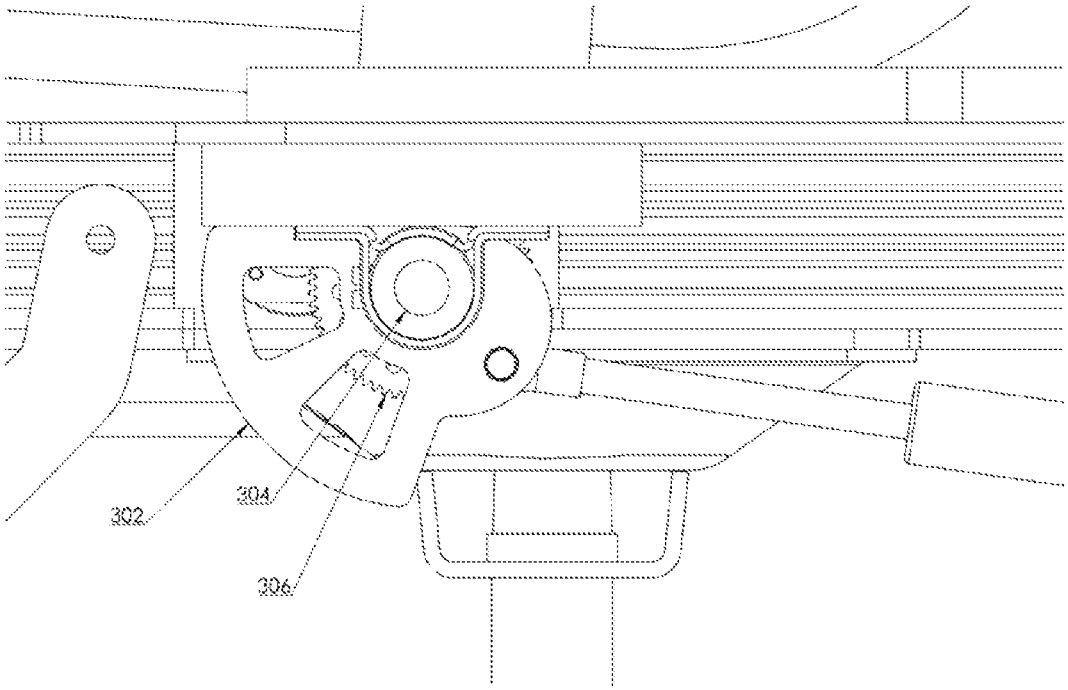

The user may select from one or more resistance modes by means of a selection mechanism 124. The force providing element(s) is/are pivotably connected to a component of the selection mechanism (e.g. as shown in FIGS. 3 A-B infra), which itself may be pivotably connected to the seat support via a shaft. It is noted that other connections types can be implemented in other example embodiments. When the user actuates the selection mechanism, the position of one end of the force providing element(s) 122 end point is changed.

Figure 2:
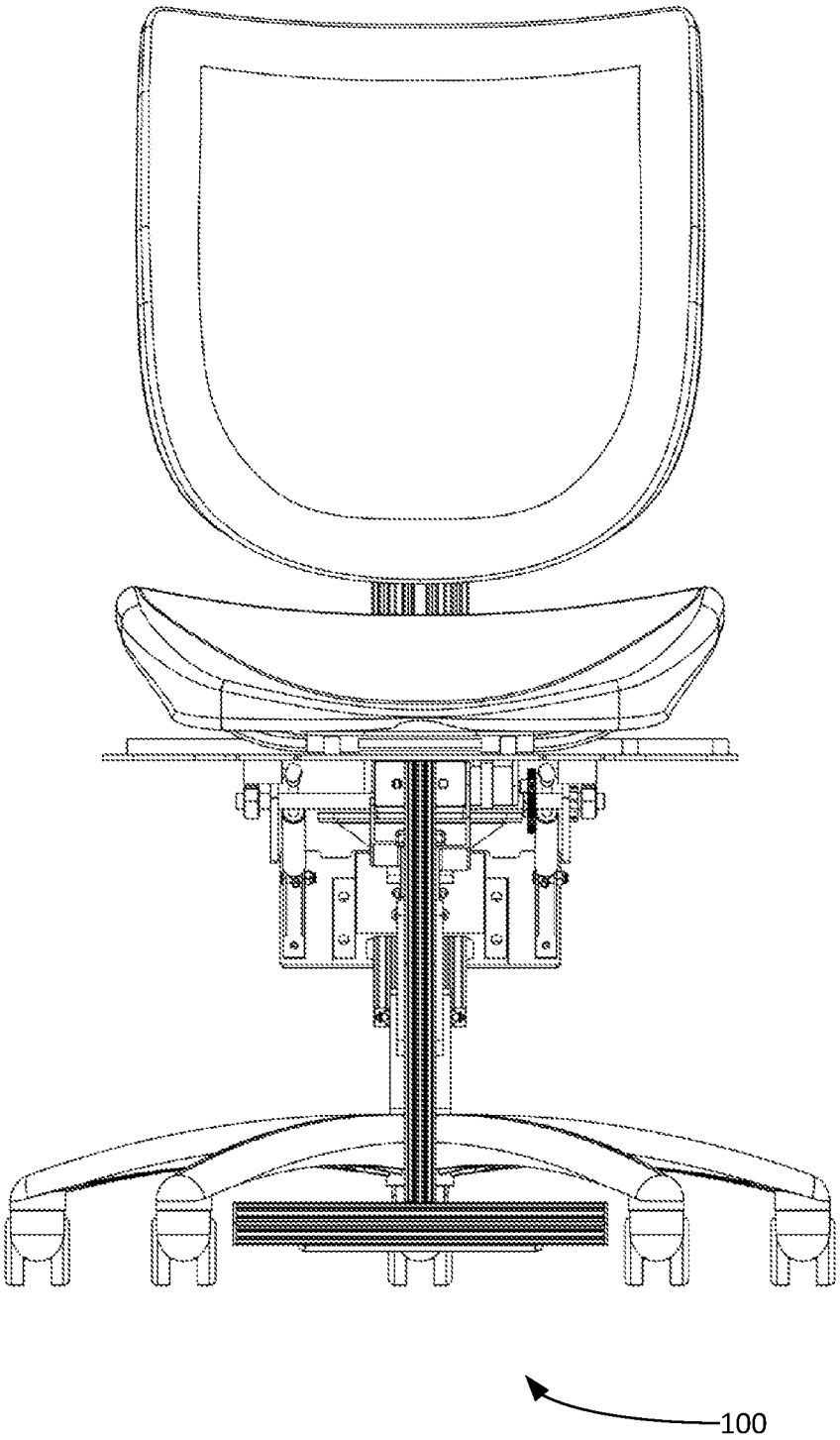
FIG. 2 illustrates a front view of an embodiment of an active exercise chair 100, according to some embodiments.

FIG. 2 illustrates a front view of an embodiment of an active exercise chair 100, according to some embodiments.

FIGS. 3 A-B illustrate an example embodiment with a pivot mounted to a selector plate, according to some embodiments. In one implementation, shown in FIGS. 3 A-B, a pivot is mounted to a selector plate 302 which pivots about a main shaft 304. The main shaft is rigidly affixed to a gear 306 which meshes with a pinion 308. The pinion may be driven by an electric motor or other mechanism. The selection mechanism is configured such that one resistance mode (referred to as a static/isometric mode) will cause the seatback to exert force against the user's back. In order to remain in an upright position, the user must resist this force utilizing the extensor muscles of the user's lower back. A sensor is included in the selection mechanism such that the selected mode may be queried by a microcomputer. Feedback may be provided to alert the user if the seatback support position is outside a therapeutically ideal range when in this mode. In one example, haptic positioning of active chair 100 can provide resistance and be used to alert the user to maintain a position range during isometric strengthening exercises. The other resistance mode (referred to as the isotonic/auxotonic mode(s), etc.) does not position the seatback in such a way as to require the user to exert a reaction force to remain in the upright seating position. In this mode, the user may exert a force against the seatback 116 in order to recline the seatback support 110 about the pivot, and in doing so exercise the extensor muscles of the lower back throughout the range of the reclining motion.

Returning to the description of other aspects of active exercise chair 100, it is noted that a microcomputer (not shown) can be included for monitoring the user's sitting and exercising activities and communicating feedback to the user. When the chair is in a static/isometric mode the user may be alerted via an output device, such as a vibratory transducer, when the seatback is outside a nominal therapeutic range. The status of the chair is provided to the microcomputer via one or more sensors. One or more of the sensors may monitor the angular position of the seatback support 110 relative to the seat support 106. This sensor may be a rotary encoder, a potentiometer, an accelerometer, and/or an angular rate sensor. Additional sensors may monitor the positions of the seatback carriage 114, the adjustment carriage 120, the selection mechanism 124, and may also directly measure the forces being applied to the seatback 116 or seat 108 and may also monitor other aspects of the user's sitting and/or exercise. This data may be processed either onboard the microcomputer or by another device with a data connection to the microcomputer. Such data may be used to provide the user with short-duration feedback, for example vibrating a transducer to remind the user to use the chair's exercise functions. It may also be used to provide to the user raw or summarized data of the user's longer-duration progress.

A sensor system can be included in the selection mechanism such that the selected mode may be queried by a microcomputer (e.g. see infra). Another resistance mode can be the dynamic mode. In this mode, the user can exert a force against the seatback 107 in order to recline the seatback support 105 about the pivot. In doing so, the user can exercise the extensor muscles (and/or core muscles and/or pelvic muscles) of the lower back throughout the range of the reclining motion.

A microcomputer system (not shown) can be included for monitoring the user's sitting and/or exercising activities.

The microcomputer system can include various network systems (e.g. Wi-Fi, Bluetooth®, etc.) for communicating feedback to computing system that can then organize and/or display the feedback to the user. When the chair is in the static/isometric mode, the user may be alerted via an output device. Example output devices, include inter alia: a vibratory transducer. The output device can alert the user when the seatback is outside a nominal ergonomic range. The status of the chair is provided to the microcomputer via the one or more sensors. One or more of the sensors may monitor the angular position of the seatback support 105 relative to the seat support 103. These sensors can be positional sensors such as, inter alia: a rotary encoder, a potentiometer, an accelerometer, an angular rate sensor; and/or etc.

Additional sensors can monitor the positions of the seatback carriage 114, the adjustment carriage 120, the selection mechanism 124, and can also directly measure the forces being applied to the seatback 116 or seat 108 and can also monitor other aspects of the user's sitting and/or exercise. Such sensors can include devices that monitor physical parameters of the chair and user, and/or devices that monitor biometric parameters of the user. Such sensors can include direct force and/or shear sensing, linear and/or angular position and/or velocity and/or acceleration sensing, temperature sensing, heart rate sensing, muscle activation sensing, and/or other physical and biometric sensors known in the art. This data can be processed either onboard the microcomputer or by another device with a data connection to the microcomputer. Such data can be used to provide the user with short-duration feedback, for example vibrating a transducer to remind the user to use the chair's exercise functions. It can also be used to provide to the user raw or summarized data of the user's longer-duration progress. To communicate such feedback to the user, the embodiment can include transducers and/or displays that engage any of the sensory modalities such as audio transducers, visual displays, electrocutaneous stimulators, olfactory emitters, and/or any other means known in the art.

The embodiment can also include actuators and/or transducers with the means to adjust some physical parameter of the device. Such actuators can be used to adjust, for example, the position of the adjustment carriage via a leadscrew actuator; the torque acting upon the pivot via an electromechanical brake. Such actuators can operate independently of or in conjunction with the user feedback system.

The chair also includes an adjustable footrest assembly 126 which can assist the user in performing the exercises by positioning the user's feet appropriately and consistently. The chair also can have a pair of armrests that can also have exercise functionality. The chair can also have a headrest, which can also have exercise functionality.

It is noted that various other resistance systems can be integrated with active exercise chair 100. This include resistance systems for exercising a user's arms, hands, legs, feet and/or neck. Various sensors such as pulse sensors, respiratory rate sensors, galvanic skin response sensors, etc. These systems and/or sensors can be monitored, and an overall physiological state of the user can be calculated. This data can be presented to a user via a mobile-device application interface. The sensor data of active exercise chair 100 can also be integrated with that of other physiological monitoring devices worn by the user (e.g. an activity tracker, biomedical sensors, etc.).

In some examples, arm rest and/or head/neck rest attachments can be integrated into active exercise chair 100. For example, pneumatic and/or springs-based telescoping mechanisms can be integrated into the arms of chair rests such that while one-part slides under resistance into another, stable part of the arm. In this way, user arm exercises can be performed. In another example, a head-rest mechanism with vertical axial resistance (e.g. pneumatic or springs based) upon can be integrated in the active exercise chair 100 to provide rotation exercise for the strengthening of neck muscles.

FIGS. 4 A-C illustrate an active exercise chair 100 with a seatback carriage (e.g. seatback carriage 114) that is slidably connected to the seatback support (e.g. seatback support 110) as active exercise chair 100, according to some embodiments. Forward position 402 shows the resistance carriage 120 position forward from a neutral position. This position is used to initiate the isometric mode of exercise, when the user deliberately brings the active exercise chair into neutral position 408 or into a relative vertical range (e.g. plus or minus five percent degrees of verticality under the resistance, etc.). The vibratory sensor can be activated in the forward chair back position until the chair back is returned to a more ergonomically appropriate degree of positionality/verticality (e.g. plus or minus five percent degrees) when the vibratory sensor ceases the alert. This improves posture when seated in the active exercise chair 100 and the isometric resistance exercise mode is engaged.

Position 404 illustrates the resistance carriage 120 closest/nearest to the pivot point 112. This provides the lowest degree of torque during the recline and lowest degree of deliberate muscle exertion. Position 406 illustrates the resistance carriage 120 farthest to the pivot point 112. This provides the highest degree of torque during the recline and highest degree of deliberate muscle exertion.

Neutral position 408 illustrates the resistance carriage 120 in a middle/mid-shaft position. Reclined position 410 shows the chair back in a complete reclined position (e.g. achieved during dynamic resistance exercise mode). The recline can be performed respectively until a desired number of repetitions is achieved. The angle of recline can be set based on user preferences. The user brings the chair back into the reclined position while exerting effort, thus, engaging multiple back, core, pelvic and thigh muscles under a desired degree of resistance. The chair back returns to neutral position 408 via a recoil force (e.g. pneumatic, spring, etc.) when the exertion of the user ceases.

Figure 4A:
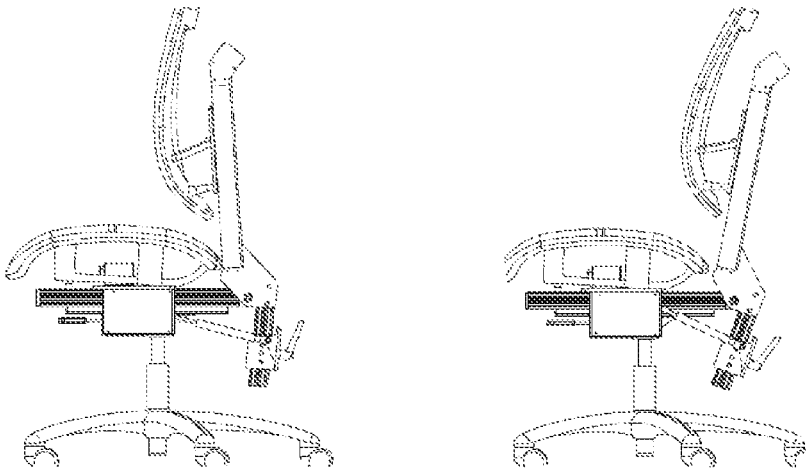
FIGS. 4 A-C illustrate an active exercise chair with a seatback carriage that is slidably connected to the seatback support as active exercise chair, according to some embodiments.
Figure 4B:
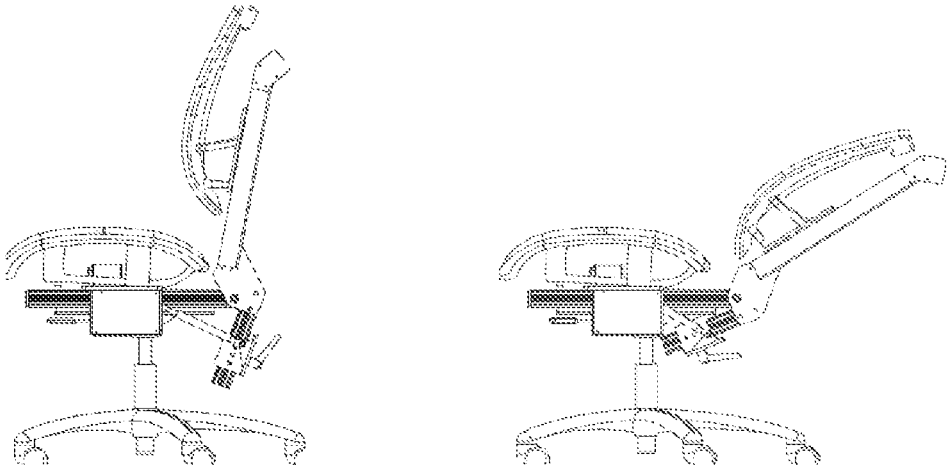

FIG. 4A illustrates an active exercise chair with a seatback support in a neutral position 408 and forward position 402. FIG. 4B illustrates an active exercise chair with a seatback support in a neutral position 408 and a reclined position 410.

Figure 4C:
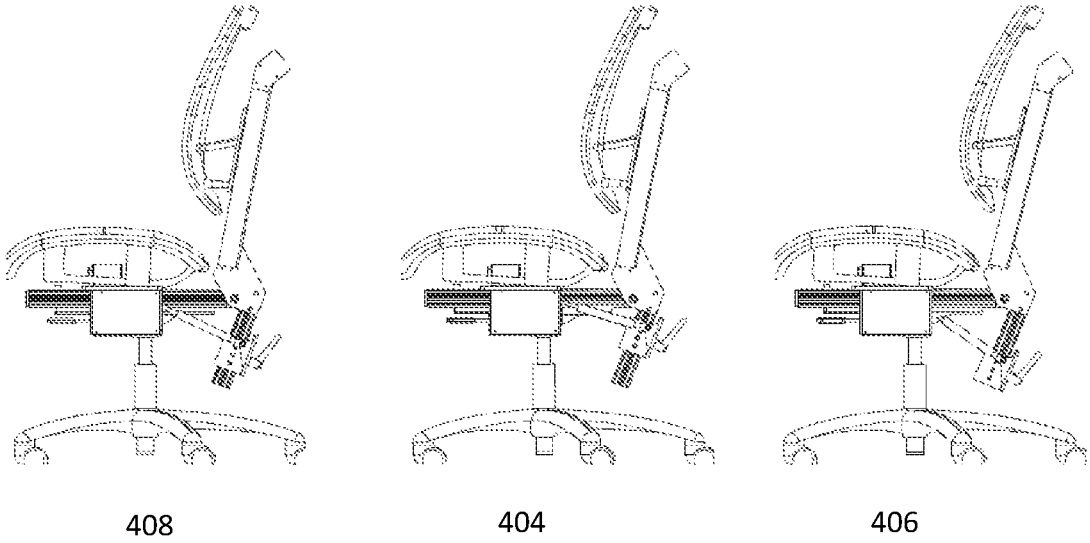

FIG. 4C illustrates an active exercise chair with a seatback support in a neutral position 408 with three varied positions of a resistance carriage 120 in relation to the pivot point (e.g. a nearest 404, middle 408 and farther 406). In order to modify the degree of torque, the resistance carriage 120 is either positioned towards the pivot point 404 (which provides the lowest degree of torque), or away from the pivot point 406 (which provides the highest dree of resistance torque and the highest degree of effort and muscle engagement).

Figure 5:
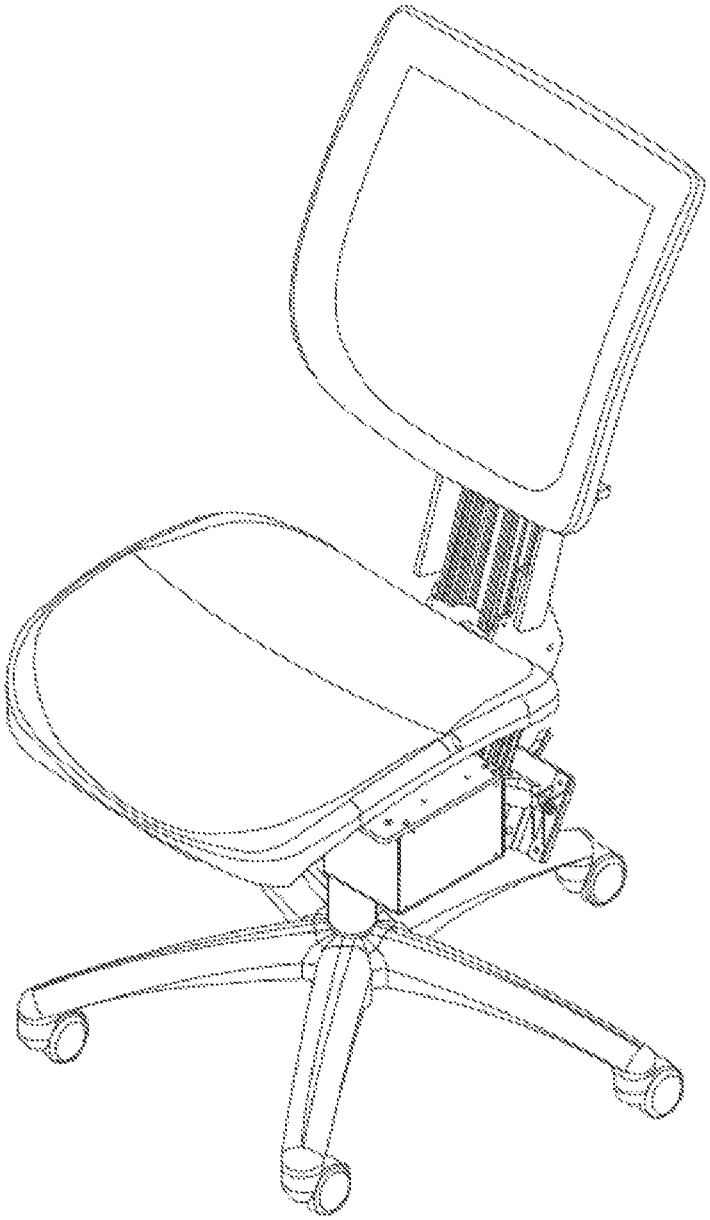
FIGS. 5 and 6 illustrate perspective drawings of active exercise chair, according to some embodiments.
Figure 6:
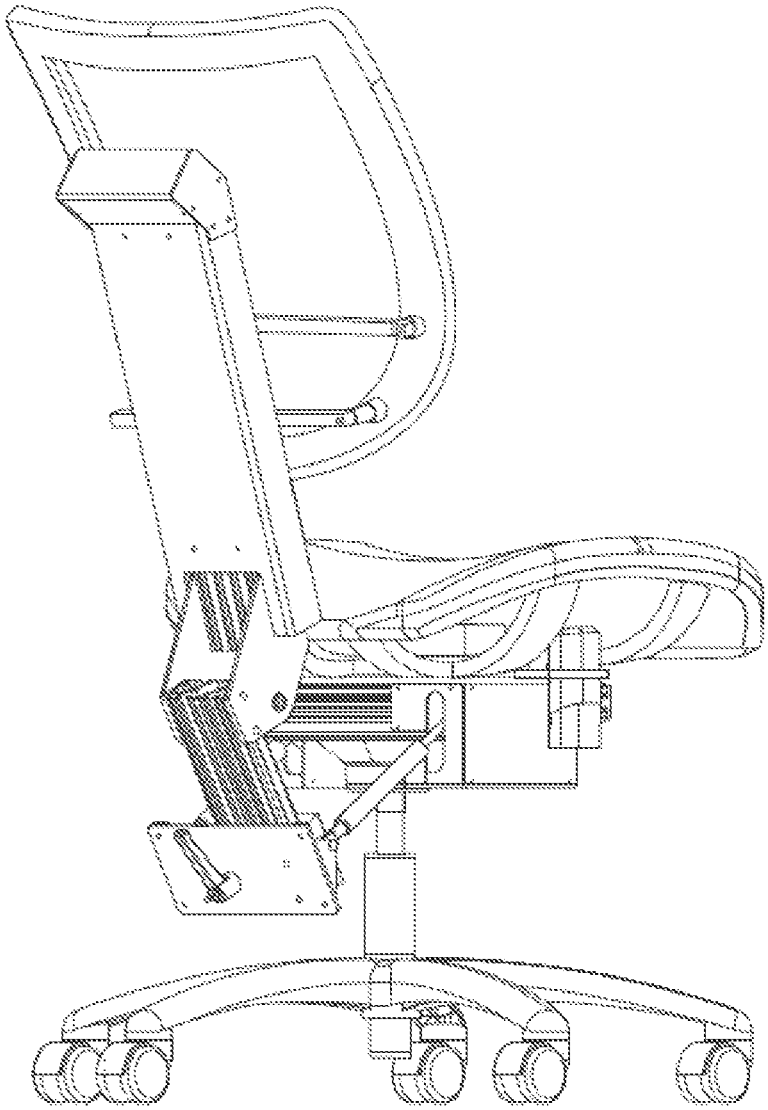

FIGS. 5 and 6 illustrate perspective drawings of active exercise chair 100, according to some embodiments.

FIGS. 7-12 illustrates an armrest upright/chair back assembly 700, according to some embodiments. FIGS. 7-12 show active exercise chair 100 with an exercise armrest 702 in various states of reclining and activation. Active exercise chair 100 can include the mechanical systems of FIGS. 1-6 for implementing the exercises provided supra. It is noted that armrest upright/chair back assembly 700 can include a pair of armrests, each capable of independent and/or simultaneous use.

Exercise armrest 702 is configured to allow a user to volitionally move a part of an armrest while seated in a chair for the purpose of providing strengthening exercise to the arms and upper body. Exercise armrest 702 is configured to have two parts: a movable top part holding a resistance spring (and/or other mechanism such as an elastic object or pneumatic system, etc.) which the user is able to translate against a second part. The second part can be a fixed armrest upright serving as a base. In one example mode of operation, a gradual compression force applied by a user creates a progressive increase in a resistance force which the user has to overcome by tensing his/her arms and upper body muscles. In this way, the user performs an exercise that exercises and tones the utilized muscles (e.g. when performed in a frequent and repetitive manner). It is noted that the resistance force can vary with the distance the armrest is pulled backward. In this way, the degree of exercise can therefore be customized.

In the case of two armrests used simultaneously, a symmetrical movement can be created. In another example, each armrest can be used independently. In this example, a partial twisting motion of the torso can be generated that engages additional trunk muscles (e.g. core, oblique and other muscles).

As shown, exercise armrest 702 can be used simultaneously with the chair backward resistance mechanism of the active fitness chair in order to provide a more comprehensive body toning exercise effect with more muscles of the body engaged. The coupled motion of the seat back reclining movement under adjustable resistance and exercise armrest 702 backwards translation under a customizable resistance can reproduce a rowing-type of movement generating fuller fitness effect on the body.

Figure 12:
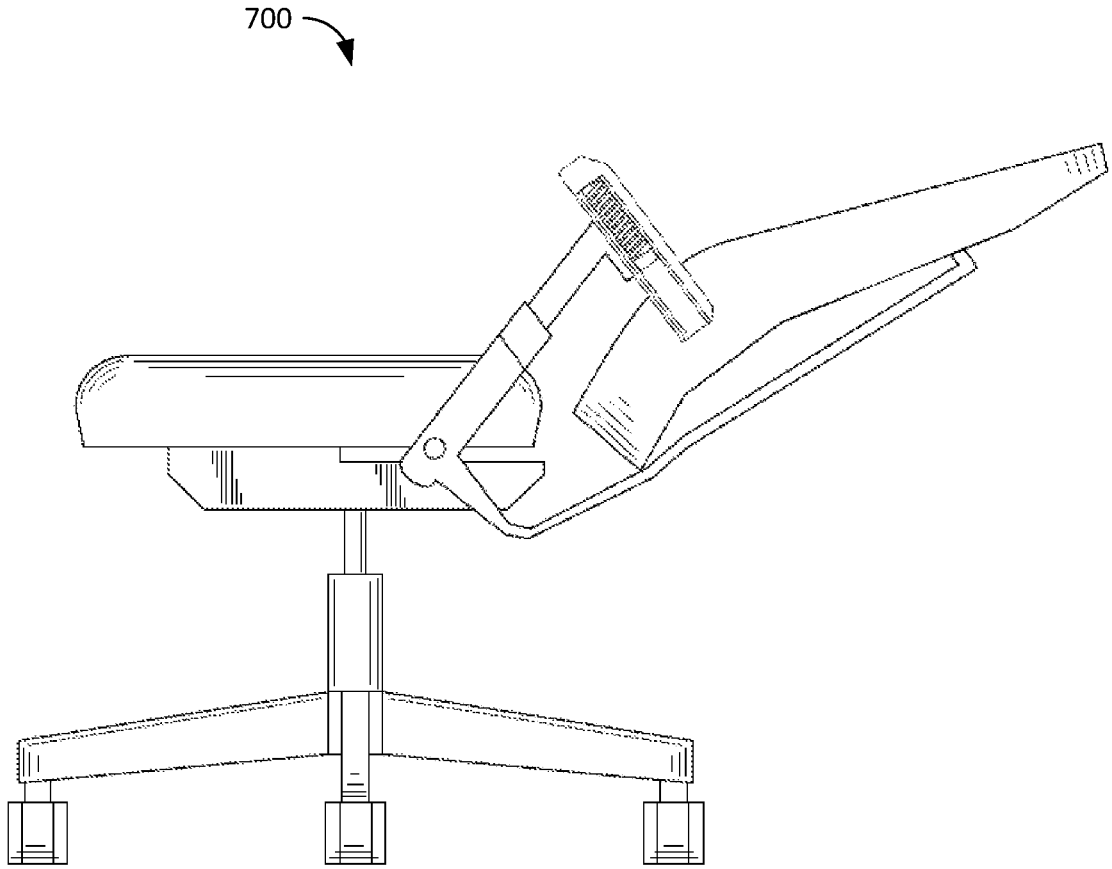
Figure 13:
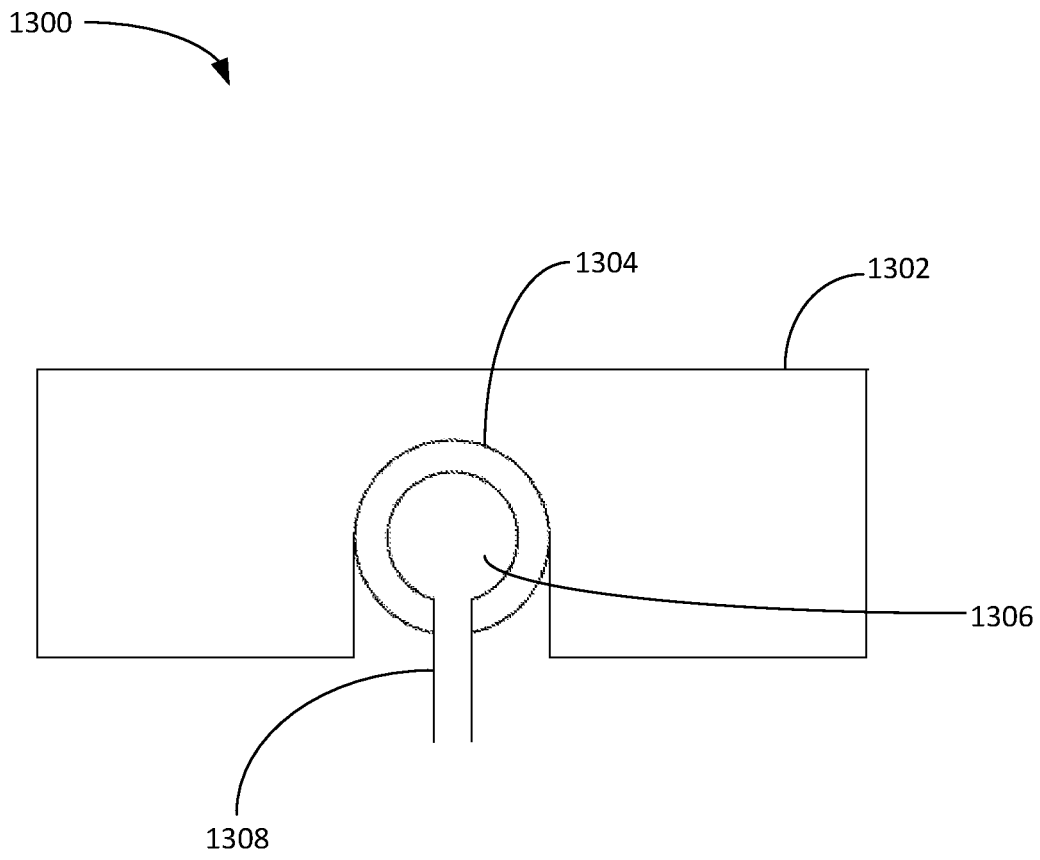
FIGS. 13-15 illustrate example configurations and views of an exercise armrest, according to some embodiments.
Figure 14:
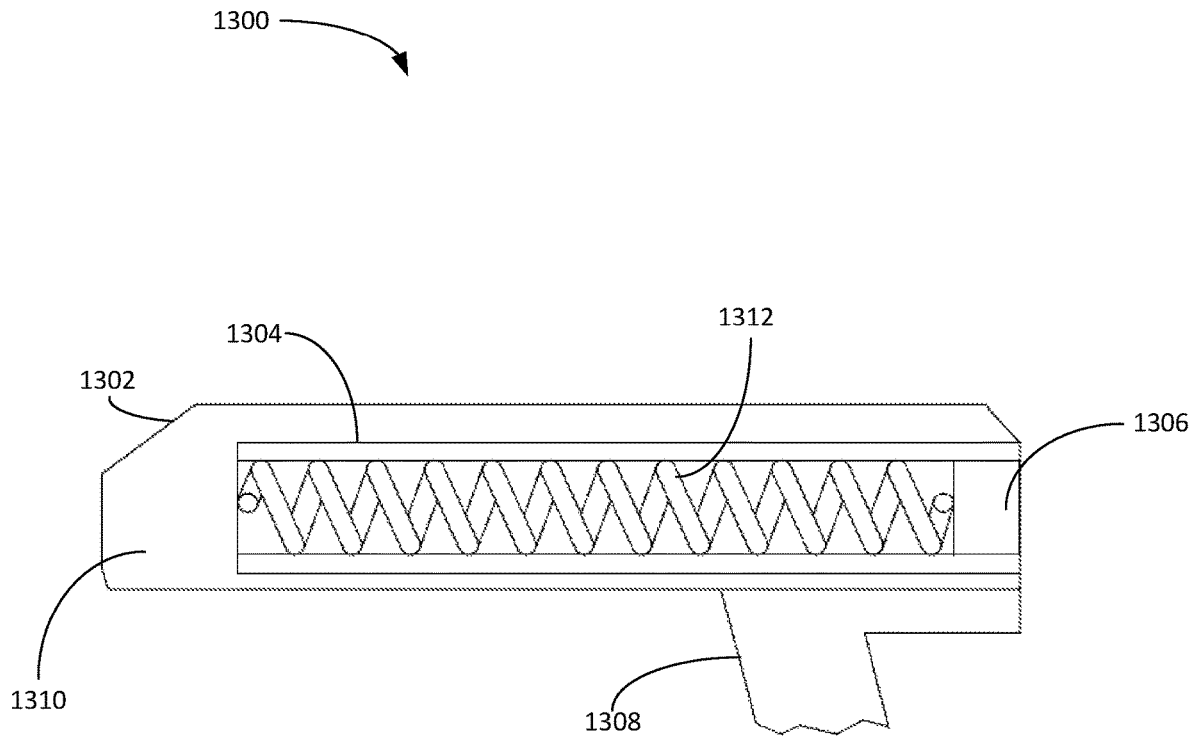
Figure 15:
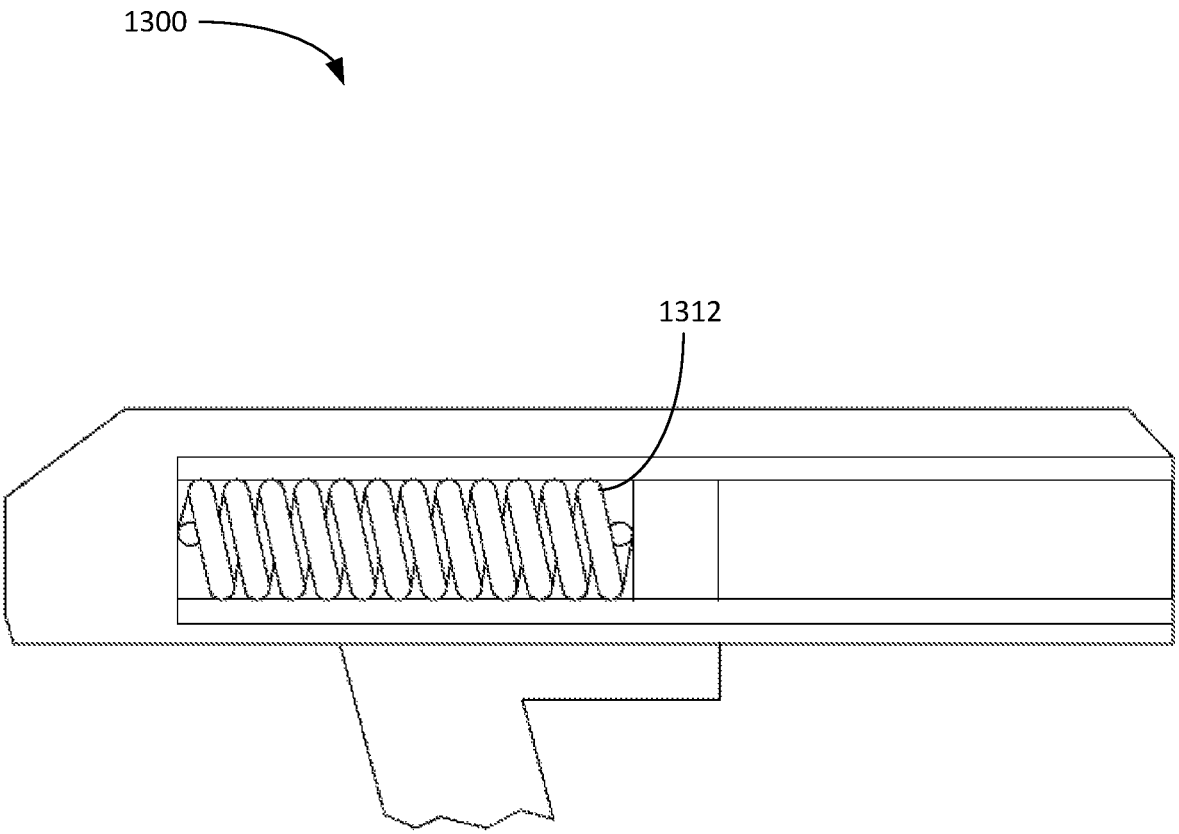

FIGS. 13-15 illustrate example configurations and views of an exercise armrest 1300, according to some embodiments. Exercise armrest 1300 can be integrated as exercise armrest 702 of FIGS. 7-12. Exercise armrest 1300 includes an armrest tube 1304. Armrest tube 1304 is embedded in exercise armrest 1300. Armrest tube 1304 is slotted on the bottom. Armrest tube 1304 extends from the rear of the armrest to armrest front 1310.

Armrest upright 1308 is attached to armrest upright piston 1306 fitted inside armrest tube 1304. The armrest upright piston 1306 is positioned near the back of the armrest. Passive spring 1312 is fitted inside armrest tube 1304, between armrest front 1310 and armrest upright piston 1306. Exercise armrest 1300 can slide backward relative to armrest upright 1308 when pressure is applied to the front of exercise armrest 1300 to compress passive spring 1312. The user can pull backwards in a repetitive, rowing-like manner against the resistance provided by passive spring 1312 achieving a body toning exercise effect. The user can also pull backwards and hold the position with passive spring 1312 compressed, to achieve the same body toning effect in an isometric manner.

Figure 7:
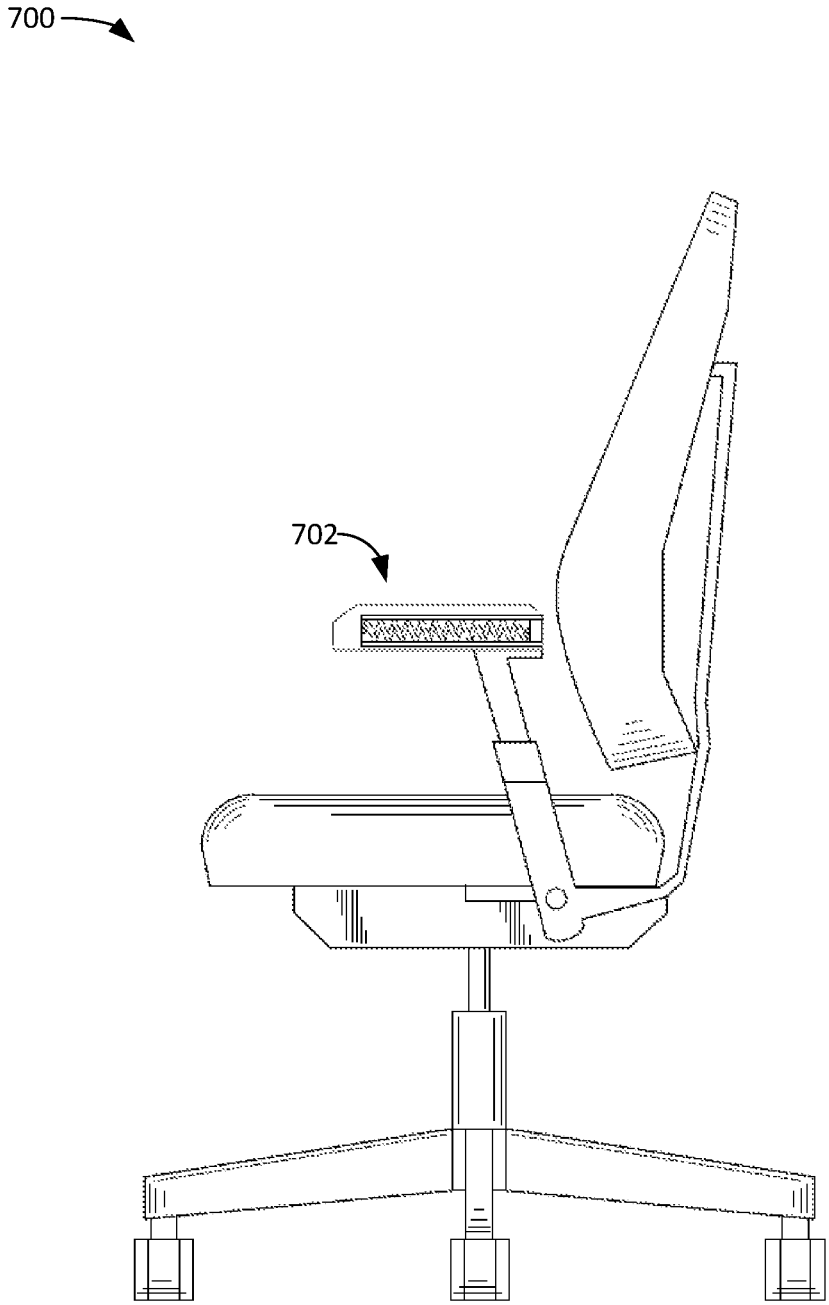
FIGS. 7-12 illustrates an armrest upright/chair back assembly, according to some embodiments.
Figure 8:
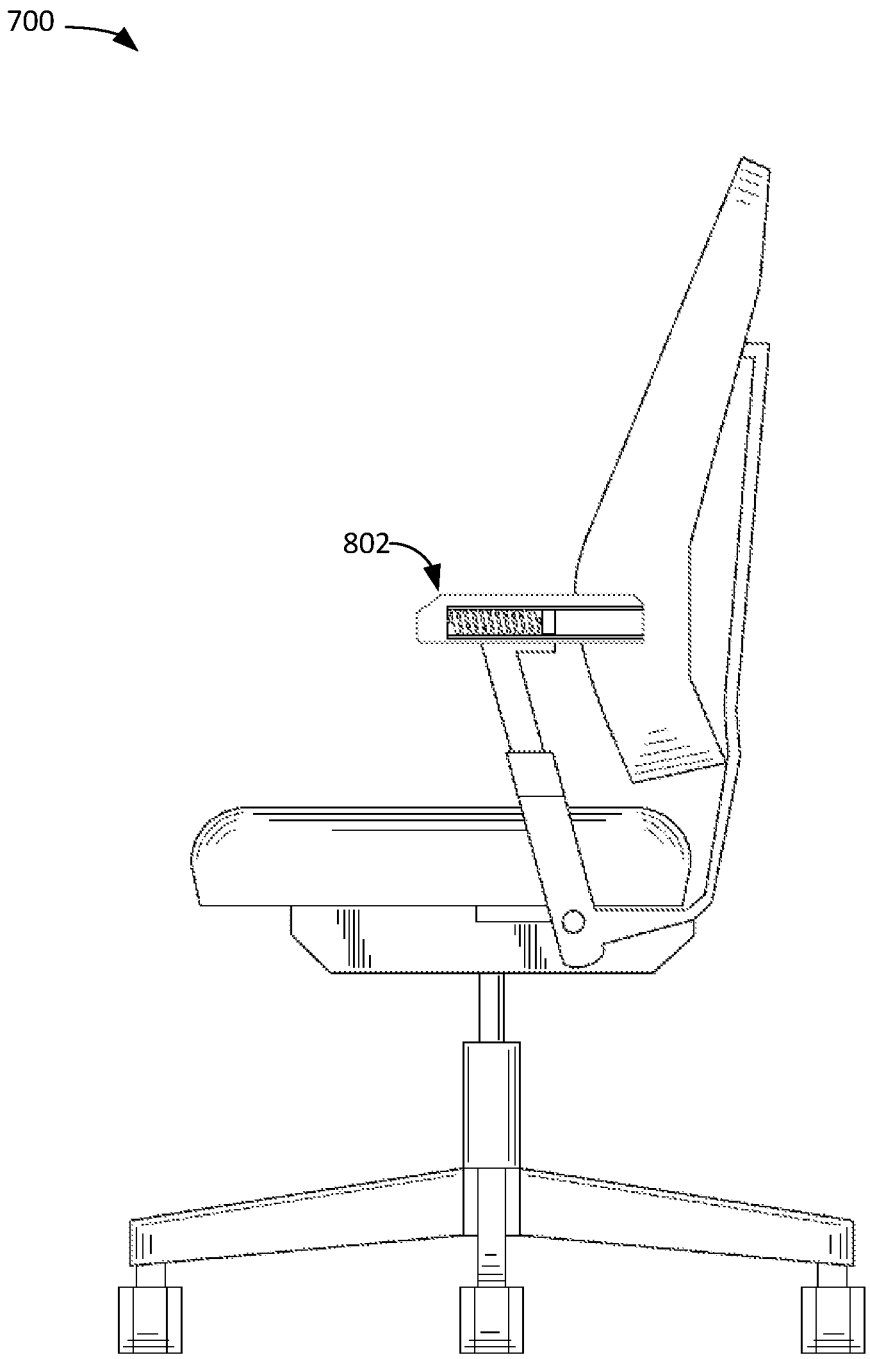
Figure 9:
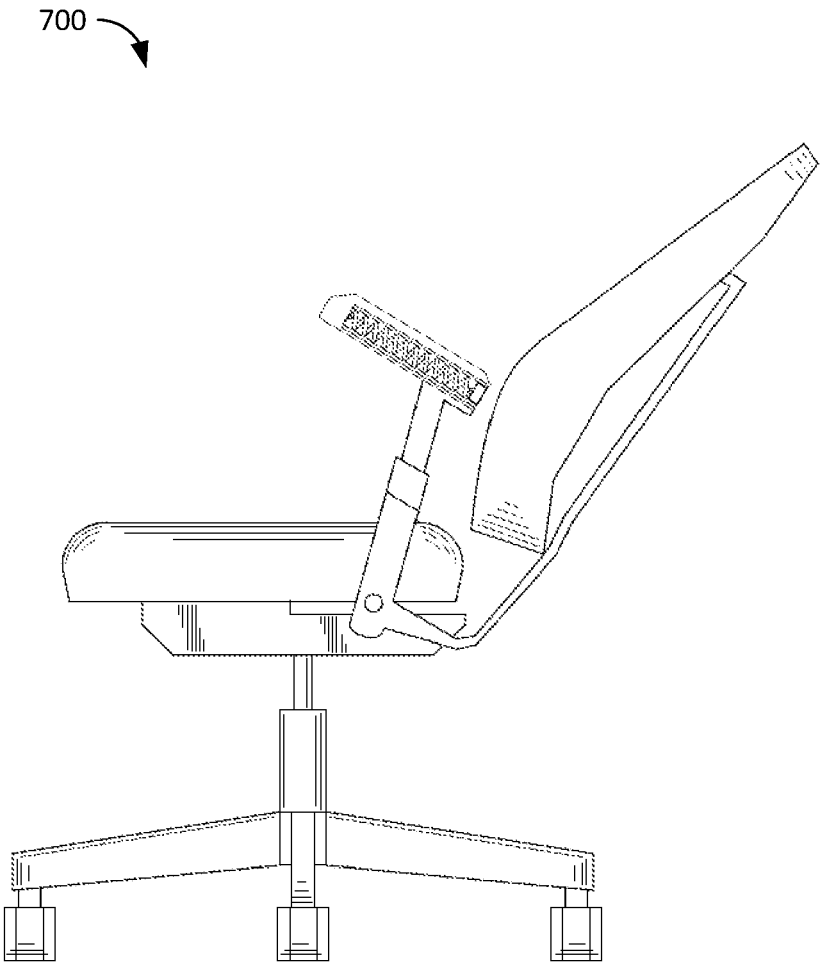
Figure 10:
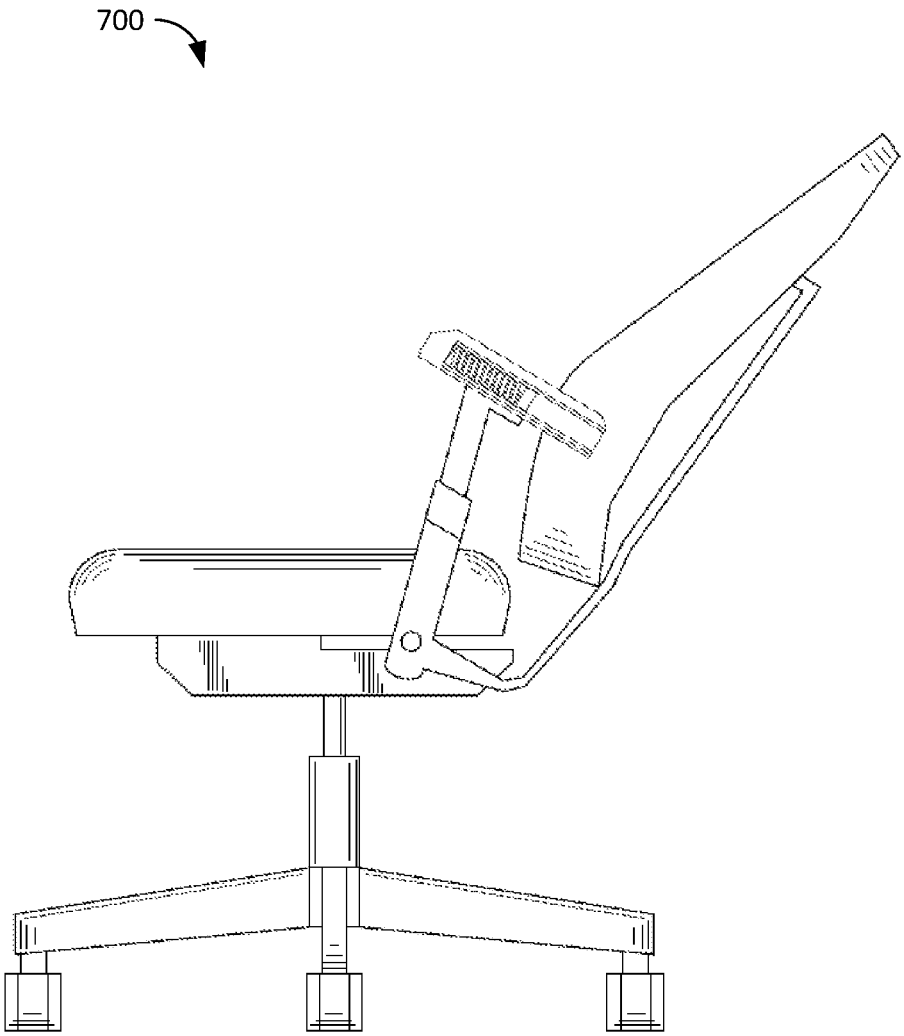
Figure 11:
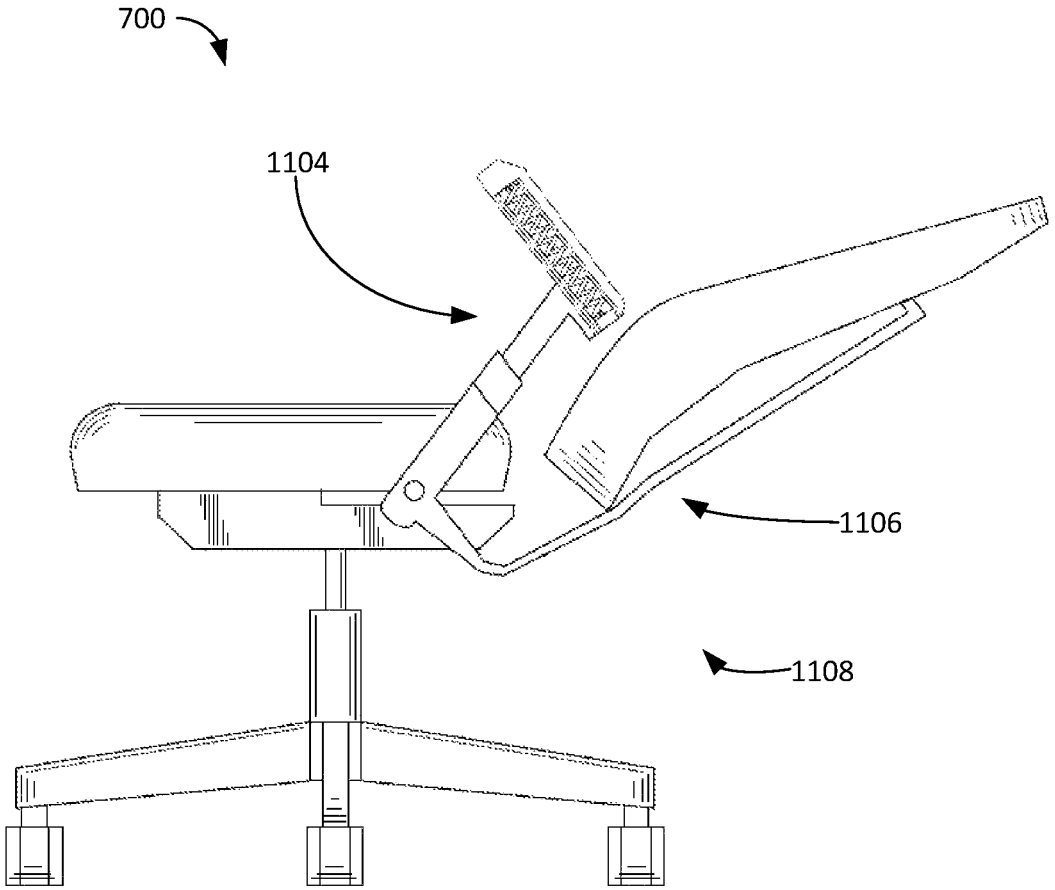

Armrest upright 1308 is affixed to chair back 704 of active exercise chair 100. Armrest upright 1308 and chair back 704 is collectively called the armrest upright/chair back assembly 700. The armrest/chair back assembly 700 is hinged on the chair base to allow the armrest/chair back assembly 700 to rotate relative to the chair base. This configuration of the armrest/chair back assembly 700 allows a comfortable constant angle of the user's arms while sitting upright or while reclining. Therefore, the EAR can function in an upright chair position (e.g. as shown in FIGS. 7-8), a partially reclined chair back position (e.g. as shown in FIGS. 9-10), or a fully reclined chair back position (e.g. as shown in FIGS. 11-12) independently from the position of chair back 704.

The function of the resistance provided by passive spring 1312 can also be achieved using pneumatic resistance mechanisms, electromagnetic resistance mechanisms, constant force resistance springs and others. The force can be adjusted for personalized customization by using different resistance mechanisms. The force can provide a resistance to arm extension motion or arm flexion motion while the forearm rests upon the exercise armrest.

CONCLUSION

Although the present embodiments have been described with reference to specific example embodiments, various modifications and changes can be made to these embodiments without departing from the broader spirit and scope of the various embodiments.

What is claimed:

1. An active exercise chair comprising:

a seat support, wherein the seat support is rigidly affixed to a top section of a shaft of a locking gas spring assembly;

a seat, wherein the seat is connected to the seat support;

a seatback support, wherein the seatback support is pivotably connected to the seat support about a discrete pivot point;

a seatback carriage, wherein the seatback carriage is slidably connected to the seatback support, wherein the seatback carriage is connected to a seatback, and wherein the seatback traverses a translational path defined by a geometry of the seatback carriage and the seatback support;

an adjustment carriage configured to enable a user to modify a torque profile exerted by a force providing element to the seatback support about the discreet pivot point, and wherein an end of the force providing element is pivotably connected to the adjustment carriage, and wherein the adjustment carriage is slidably connected to a lower portion of the seatback support; and an exercise armrest comprising a resistance element configured to provide a resistance force in response to an arm motion of the user while a forearm of the user rests upon the exercise armrest, wherein the resistance force is provided by a horizontally-oriented armrest piston fitted inside an armrest tube of the exercise armrest, wherein the horizontally-oriented armrest piston is positioned in a back portion of the exercise armrest, wherein a passive spring is fitted inside the armrest tube between a front of the exercise armrest and the horizontally-oriented armrest piston, wherein the exercise armrest is coupled with an armrest upright and is slidable backward relative to the armrest upright when pressure is applied to the front of the exercise armrest to compress the passive spring.

2. The active exercise chair of claim 1, further comprising:

a caster assembly coupled with the active exercise chair.

3. The active exercise chair of claim 1, wherein the seat is rigidly connected to the seat support.

4. The active exercise chair of claim 1, wherein the seat is pivotably connected to the seat support.

5. The active exercise chair of claim 1, wherein the seat is slidably connected to the seat support.

6. The active exercise chair of claim 1, wherein the seatback is rigidly connected to the seatback carriage, pivotably connected to the seatback carriage about one or more axes or slidably connected to the seatback carriage.

7. The active exercise chair of claim 1, wherein an impetus for a translational motion of the seatback carriage is provided by a contact force between the seatback and a back of the user.

8. The active exercise chair of claim 1, wherein an impetus for a translational motion of the seatback carriage is provided by an explicit mechanical coupling between one or more pivotably connected members of the seatback support and the seat support.

9. The active exercise chair of claim 1, wherein the seatback carriage is held in a position such that the seatback carriage translates toward the discrete pivot point when the active exercise chair is being reclined by the user.

10. The active exercise chair of claim 1, further comprising:

a counterbalance assembly consisting of a rotating drum and one or more constant-force springs that counteract a gravity force acting on the seatback and the seatback carriage when the seatback support is in an upright position.

11. The active exercise chair of claim 10, wherein the force providing element is replaced by a torsional spring assembly or a rotary actuator.

12. The active exercise chair of claim 11, wherein by moving the adjustment carriage further from a location of the discrete pivot point, a magnitude of a torque produced at the discrete pivot point is increased and by moving the adjustment carriage closer to the discrete pivot point, the magnitude of the torque produced at the discrete pivot point is reduced.

13. The active exercise chair of claim 12, wherein a selection mechanism is configured to enable the user to select from one or more resistance modes.

14. The active exercise chair of claim 13, wherein the force providing element comprises a torsional spring assembly or a rotary actuator.

15. The active exercise chair of claim 14, wherein the locking gas spring assembly provides a height adjustment for the active exercise chair.

16. The active exercise chair of claim 1, wherein the armrest tube is slotted on a bottom portion of the exercise armrest and extends from a rear of the exercise armrest to the front of the exercise armrest.

17. The active exercise chair of claim 1, wherein the user's arm motion comprises an arm extension motion or an arm flexion motion while the user's arm rests on the exercise armrest.

* * * * *